US010550838B2

(12) United States Patent
Mancuso et al.

(10) Patent No.: US 10,550,838 B2
(45) Date of Patent: Feb. 4, 2020

(54) SYSTEM AND METHOD FOR PREVENTING FLOATING ROD EFFECT IN A SUCKER ROD PUMP

(71) Applicant: Control Microsystems Inc.

(72) Inventors: Bernardo Martin Mancuso, Houston, TX (US); Zackrey Sobin, Raleigh, NC (US)

(73) Assignee: Schneider Electric Systems USA, Inc., Foxboro, MA (US)

( * ) Notice: Subject to any disclaimer, the term of this patent is extended or adjusted under 35 U.S.C. 154(b) by 57 days.

(21) Appl. No.: 15/390,605

(22) Filed: Dec. 26, 2016

(65) Prior Publication Data

US 2017/0234310 A1 Aug. 17, 2017

Related U.S. Application Data

(60) Provisional application No. 62/271,931, filed on Dec. 28, 2015.

(51) Int. Cl.

| | |
|---|---|
| ***F04B 49/20*** | (2006.01) |
| ***F04B 47/02*** | (2006.01) |
| ***E21B 43/12*** | (2006.01) |

(52) U.S. Cl.
CPC ..... *F04B 49/20* (2013.01); *E21B 43/127* (2013.01); *F04B 47/022* (2013.01)

(58) Field of Classification Search
CPC ..... F04B 47/02; F04B 47/022; F04B 49/065; F04B 2203/0209; F04B 2201/0202; F04B 49/20; E21B 43/127
See application file for complete search history.

(56) References Cited

U.S. PATENT DOCUMENTS 5,224,834 A * 7/1993 Westerman ..... E21B 47/0008 417/12
2006/0067834 A1* 3/2006 Boyer ..... F04B 47/02 417/44.1

* cited by examiner

*Primary Examiner* — Kenneth J Hansen

(57) ABSTRACT

A system and method for pumping formation fluids from a well using a sucker rod pumping system that prevents the pumping system from experiencing a floating rod condition. The sucker rod pumping system comprises a pump drive system, a rod string, and a downhole reciprocating pump driven by the rod string. The pump drive system is coupled to the rod string by a bridle. In addition, the sucker rod pumping system comprises a drive control system that controls the speed of the pump drive system during the downstroke. The drive control system is coupled to a load cell configured to provide a signal representative of load on the rod string. The drive control system controls the speed of the pump drive system during the downstroke based on the load on the rod string so that the rod string does not experience a floating rod condition.

6 Claims, 6 Drawing Sheets

SYSTEM AND METHOD FOR PREVENTING FLOATING ROD EFFECT IN A SUCKER ROD PUMP

RELATED APPLICATIONS

This application claims priority to U.S. Provisional Patent Application No. 62/271,931 filed on Dec. 28, 2015, which is hereby expressly incorporated herein.

BACKGROUND

1. Field of the Invention

The present invention relates generally to pumps and, more specifically, to a system and method for preventing floating rod effect in a reciprocating pump having a pump rod.

2. Description of the Related Art

This section is intended to introduce the reader to aspects of art that may be related to aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

A pump typically is used to lift oil from a subterranean oil reservoir to the surface. There are many different types of pumps that have been used to pump oil from an oil well. A commonly used type of pump for retrieving oil from a wellbore is known as a "sucker rod" pump unit. A sucker rod pump unit is a system that operates a downhole reciprocating pump linked to a surface prime mover by a rod string. The pump produces well fluids to the surface through production tubing. The rod string runs inside the production tubing and is connected to a piston within the downhole pump. The rod string is immersed in the well fluids. The opposite end of the sucker rod is supported by a bridle coupled to a reciprocating unit. The reciprocating unit lifts the bridle and the sucker rod string to produce an upward stroke of the downhole reciprocating pump. The downward stroke of the downhole reciprocating pump is achieved by letting gravity pull the rod string downward. The downhole pump may include a piston having a check valve. As the sucker rod string is lifted upward, the check valve is closed, and oil and other wellbore fluids are lifted by the plunger upward towards the surface. As the sucker rod falls downward, the check valve opens and oil and other well fluids are allowed to flow into the pump above the piston.

Because the rod string is immersed in the well fluids in the production tubing, the ability of the sucker rod to fall through the well fluids is effected by the viscosity of the well fluids. When the bridle that supports the sucker rod descends faster than the sucker rod string, the bridle may separate from the sucker rod string. When the reciprocating unit begins lifting the bridle, the sucker rod may still be descending. This can cause a violent impact when the bridle engages the sucker rod, leading to failure of the sucker rod or the bridle. It also means that the pumping unit is not producing oil during a full upward stroke. This condition is known as "floating rod effect".

The techniques described below address one or more of the problems associated with "floating rod effect".

SUMMARY OF THE INVENTION

A system and method for pumping formation fluids from a well using a sucker rod pumping system that prevents the pumping system from experiencing floating rod effect. The sucker rod pumping system comprises a pump drive system, a rod string, and a downhole reciprocating pump driven by the rod string. The pump drive system is coupled to the rod string by a bridle. In addition, the sucker rod pumping system comprises a drive control system that controls the speed of the pump drive system during the upstroke and downstroke. The drive control system is coupled to a load cell configured to provide a signal representative of load on the rod string. The drive control system controls the speed of the pump drive system during the downstroke based on the load on the rod string so that the rod string does not experience a floating rod condition.

BRIEF DESCRIPTION OF THE DRAWINGS

Advantages of the invention may become apparent upon reading the following detailed description and upon reference to the drawings in which.

DETAILED DESCRIPTION OF SPECIFIC EMBODIMENTS

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill in the art and having the benefit of this disclosure.

Figure 1:
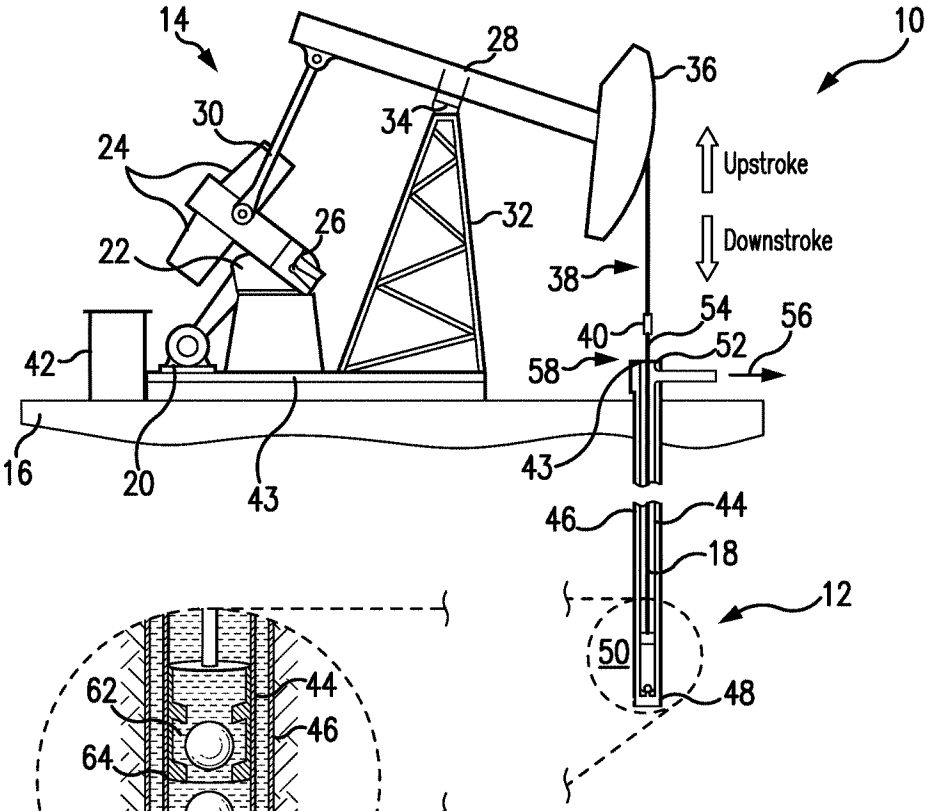
FIG. 1 is an elevation view of a sucker rod pumping system, in accordance with exemplary embodiments of the present techniques.

Referring generally to FIG. 1, a sticker rod pumping system for artificially lifting fluids from a sub-surface formation is presented and referenced generally by reference numeral 10. In the illustrated embodiment, the sucker rod pumping system 10 comprises a downhole pump 12 and a drive system 14 located on the surface 16. In the illustrated embodiment, the downhole pump 12 is a reciprocating pump driven by a rod string 18 coupled to the drive system 14.

The drive system 14 comprises a number of components configured to reciprocate the rod string 18. The drive system 14 comprises a pump motor 20 that is coupled to a gearbox 22. The gearbox 22 drives a counterweight 24 around a hub 26. The counterweight 24 is coupled to one end of a beam 28 by a crank 30. The crank 30 is offset from the hub 26. The beam 28 balances the weight between the counterweight 24 and the rod string 18, which may be several thousands of feet long. The beam 28 is mounted to a support base 32 with a rotatable connection 34. A horse head 36 is mounted to the end of the beam 28 opposite the crank 30. As the motor 20 drives the gearbox 22, the counterweight 24 is rotated and the crank 30 raises and lowers one end of the beam 28 causing the horse head 36 at the opposite end of the beam 28 to move up and down. The horse head 36 is coupled to the rod string 18 by a bridle 38. When the horse head 36 moves up, the bridle 38 lifts the rod string 18 upward. When the horse head moves down, the bridle 38 lowers and gravity pulls the weight of the rod string 18 down. In the illustrated embodiment, a load cell 40 is provided to measure the load on the rod string 18.

The drive system 14 comprises a number of components that are configured to control the speed of the rod string 18 to prevent a floating rod condition from occurring. In particular, the drive system 14 of the illustrated embodiment comprises a drive control system 42. The drive control system 42 that controls power to the motor 20 and, thereby, the speed that the drive system 14 raises and lowers the bridle 38. The drive control system 42 receives a signal from the load cell 40. In addition, an inclinometer 43 is provided to provide a signal representative of beam 28 inclination angle to the drive control system 42. This information can be used to determine the position of the rod string 18, as well, and thus providing an indication of a defined point in the pumping cycle to the drive control system 42. In this embodiment, a position sensor 44 is provided as an alternative to the inclinometer 43. The position sensor 44 provides a signal to the drive control system 42 when the counterweight 24 is passing a defined point as the counterweight 24 is rotated, indicating the end of the downstroke of the pump 12.

In the illustrated embodiment, the downhole pump 12 comprises a tubing string 45. The rod string 18 extends through the tubing string 44. The tubing string 45, in turn, is disposed within casing 46 secured into the ground and defining the wellbore. Perforations 48 are created in the casing 46 to enable formation fluids to flow into the interior of the casing 46 from the formation 50 stuffing box 52 is provided on the top of the casing 46 to enable the rod string 18 to enter the casing 46 while maintaining a seal around the rod string 18. In the illustrated embodiment, this portion of the rod string 18 is a polished rod 54. As will be discussed in more detail below, fluids, represented generally by arrow 56, are pumped from upward through the tubing string 45 and out of the casing 46 through a wellhead 58.

Figure 2:
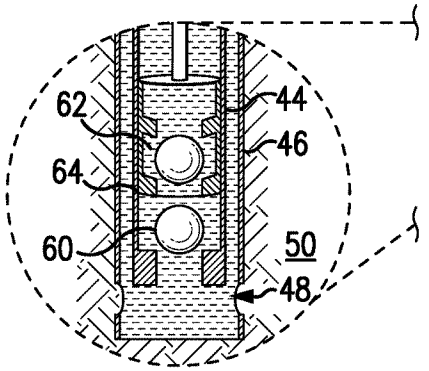
FIG. 2 is a detailed cross-sectional view of a downhole pump of the sucker rod pumping system of FIG. 1, taken along line 2-2 of FIG. 1, in accordance with an exemplary embodiment of the present techniques.

Referring generally to FIG. 2, the downhole pump 12 comprises a standing valve 60 at the bottom of the pump 12. The downhole pump 12 also comprises a traveling valve 62. The downhole pump 12 also comprises a plunger 64 at the end of the rod string 18, the plunger 64 having a plunger cavity 65. As will be discussed in more detail below, the standing valve 60 and the traveling valve 62 have balls that are configured to form seals against seating surfaces to allow formation fluids to flow into the pump 12 and then from the pump 12 up through the tubing 45.

Figure 3:
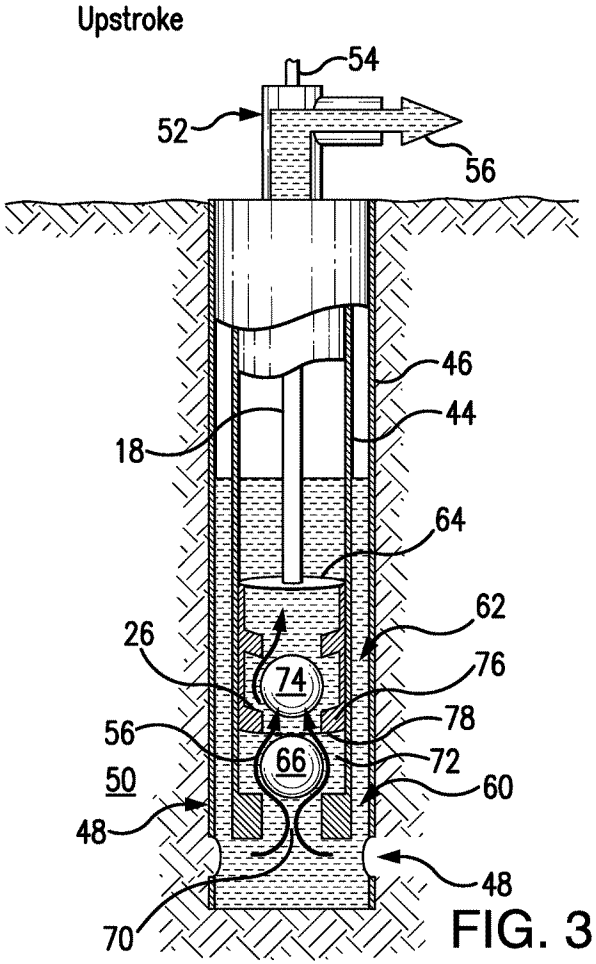
FIG. 3 is a cross-sectional view of a downhole pump of a sucker rod pumping system at the beginning of an upstroke, in accordance with exemplary embodiments of the present techniques.

Referring generally to FIG. 3, a view of the pump 12 at the beginning of an upstroke of the plunger 64 is presented. In the illustrated embodiment, the standing valve 60 comprises a ball 66 and a seat 68 around an opening 70. The travelling valve 62 also comprises a ball 72, a seat 74, and an opening 78. Above the standing valve 60 and below the traveling valve 62 is the barrel 72 of the pump 12. The travelling valve 62 also comprises a ball 74, a seat 76, and an opening 78. As the plunger 64 begins to rise, the upward motion of the plunger 64 causes the ball 74 in the traveling valve 62 to be driven against the seat 76, closing the traveling valve 62 and causing the fluids 56 in the plunger cavity 65 to be pulled upwards through the tubing string 45 by the plunger 64. In addition, a vacuum is created in the barrel 72 of the pump 12 below the plunger 64. This cause the ball 66 in the standing valve 60 to lift from its seat 68, opening the standing valve 60, and for fluids 56 to flow into the pump 12 through the opening 70 in the bottom of the standing valve 60.

Figure 4:
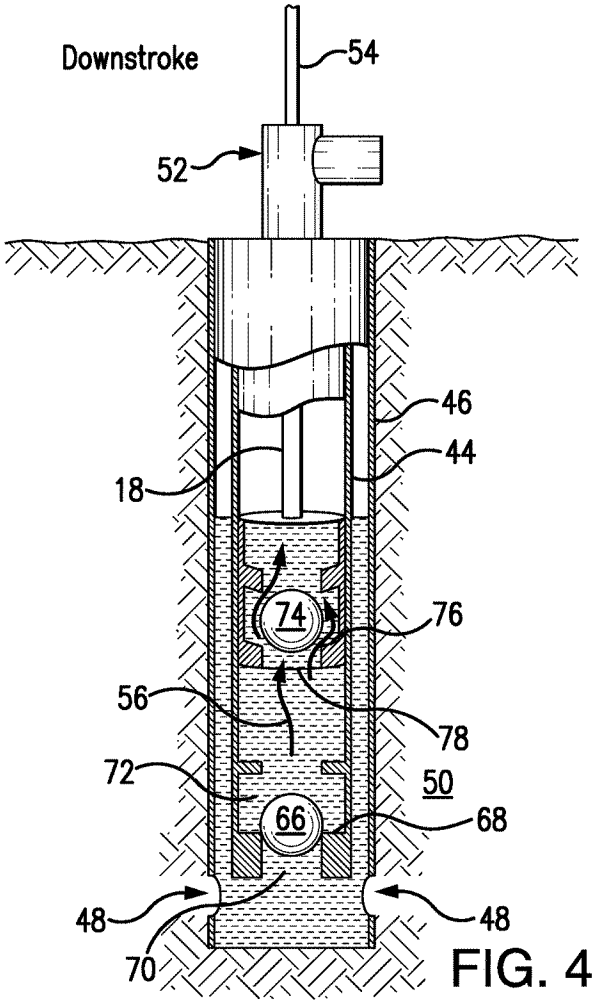
FIG. 4 is a cross-sectional view of a downhole pump of a sucker rod pumping system at the beginning of a downstroke, in accordance with exemplary embodiments of the present techniques.

Referring generally to FIG. 4, a view of the pump 12 at the beginning of the downstroke of the plunger 64 is presented. During the downstroke, the plunger 64 is allowed to be pulled downward by gravity. The ball 74 in the traveling valve 62 lifts, opening the travelling valve 62, and allowing fluids 56 in the barrel 72 to flow into the plunger cavity 65. In addition, the lowering of the plunger 64 causes the pressure in the barrel 72 to increase, forcing the ball 66 in the standing valve 60 to be driven against its seat 68, closing the standing valve 60. The viscosity of the fluids 56 in the tubing 45 and barrel 72 affects the lowering of the plunger 64, and, therefore, the rod string 18. The more viscous the formation fluid 56, the greater its opposition to downward movement of the plunger 64 and rod string 18.

Figure 5:
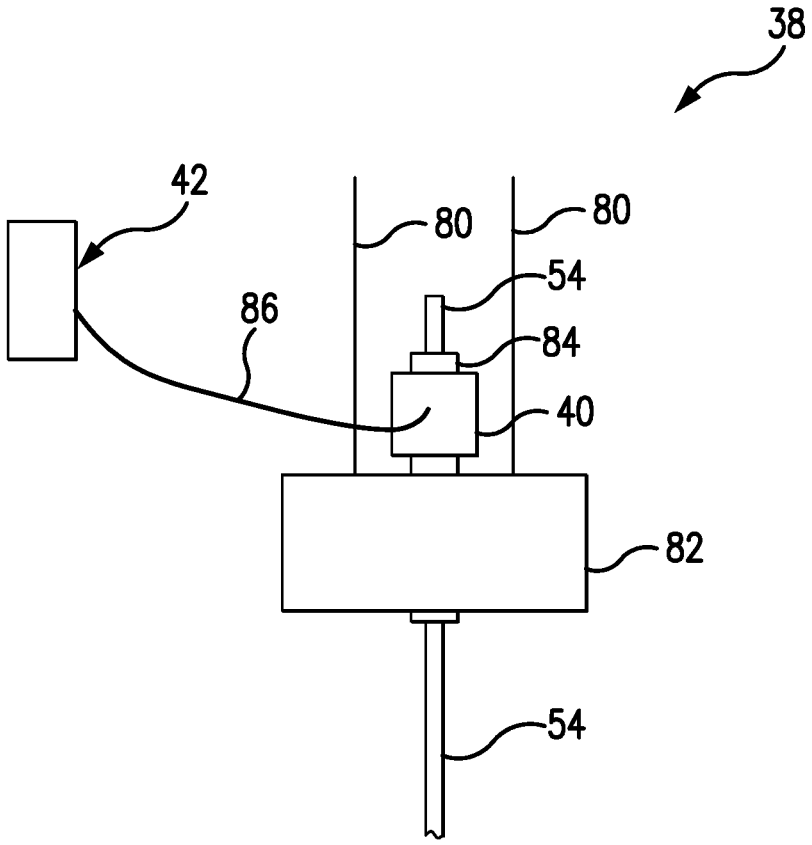
FIG. 5 is an elevation view of a bridle assembly for a polished rod of a sucker rod pumping system, in accordance with exemplary embodiments of the present techniques.

Referring generally to FIG. 5, a detailed view of the bridle 38 is presented. The bridle 38 comprises a pair of cables 80 and a polished rod clamp 82. In illustrated embodiment, the load cell 40 is disposed between the bridle 28 and the polished rod clamp 84. The load cell 40 is connected by an electrical cable 86 to the drive control system 42. During an upstroke, the bridle 38 will pull the polished rod 54 upward causing an increase in load on the polished rod 54, and a corresponding signal from the load cell 40 to the drive control system 42. During a downstroke, the bridle 38 will lower, allowing the polished rod 54 to lower. The lowering of the bridle 38 will cause a corresponding decrease in load on the polished rod 54 and a corresponding signal to the drive control system 42. The floating rod condition occurs during the downstroke phase when the speed of the polished rod 54 is less than the speed of the bridle 38 due to the viscosity of the formation fluids, meaning that the a drive control system 42 is driving the rod string 18 faster than what the oil well will allow.

Figure 6:
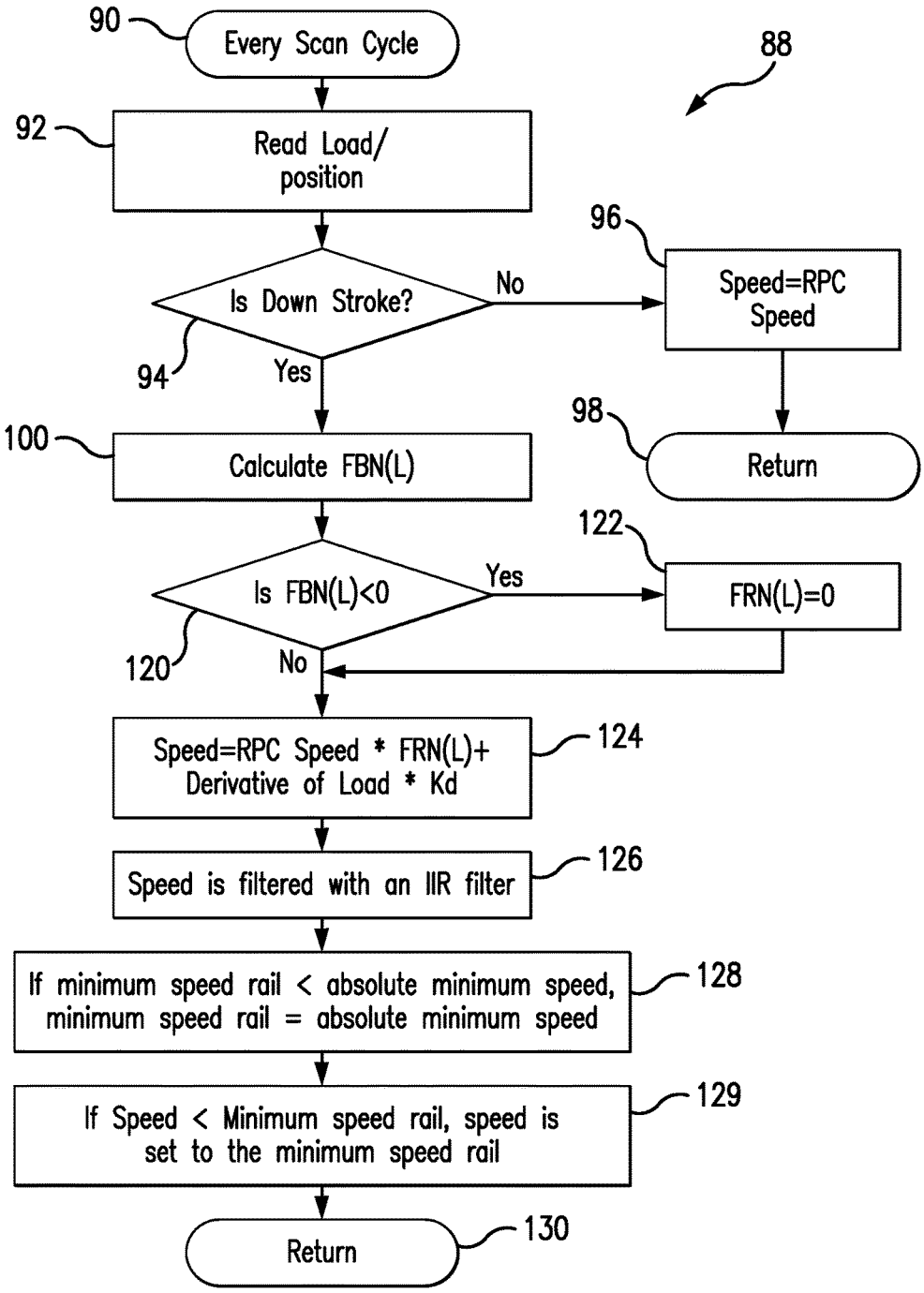
FIG. 6 is a flow chart for a pump controller of a sucker rod pumping system configured to prevent floating rod condition during the downstroke of the sucker rod, in accordance with exemplary embodiments of the present techniques.

Referring generally to FIG. 6, a method by which the drive system 14 is controlled to prevent a floating rod condition from occurring in the rod string 18 is presented, and represented generally by reference numeral 88. The drive control system 42 performs the method at regular intervals, numerous times each cycle of the pumping system 10. In the illustrated embodiment, the method begins with the start of a scan cycle, represented generally by block 90. The scan cycle comprises reading the load signal from the load cell 40 and the position sensor 43, represented generally by block 92, in this embodiment. The drive control system 42 establishes whether or not the pumping system 10 is in a downstroke, represented generally by block 94. If the pumping system 10 is not in a downstroke, then the drive control system 42 sets the motor 20 speed at the "RPC speed", as represented generally by block 96 and returns to the start of the scan cycle 90, as represented by block 98. The "RPC speed" is the speed established by drive control system 42 for upstrokes and may be manually set or automatic. If the pumping system 10 is in a downstroke, then the drive control system 42 processes the rod string load data using a function, "FRN(L)", represented generally by block 100. In the illustrated embodiment, the "FRN(L)" function is based on another function, "FR(L)":

$$FR(L) = \frac{L(t) - L\min}{L(t)} \tag{1}$$

Where:

L(t) is the load on the rod string 18 detected by the load cell 40; and

L(min) is a minimum desired load on the rod string.

The Lmin value selected should be greater than zero since a L(t) value of zero is indicative of floating rod effect. From the FR(L) function, the drive control system 42 then established the value of the FRN(L) function:

$$FRN(L)=FR(L)^{\alpha} \tag{2}$$

Where:

$\alpha$ is an exponential factor controlling the sharpness of the signal controlling the motor 20 when approaching the minimum load, Lmin.

Figure 7:
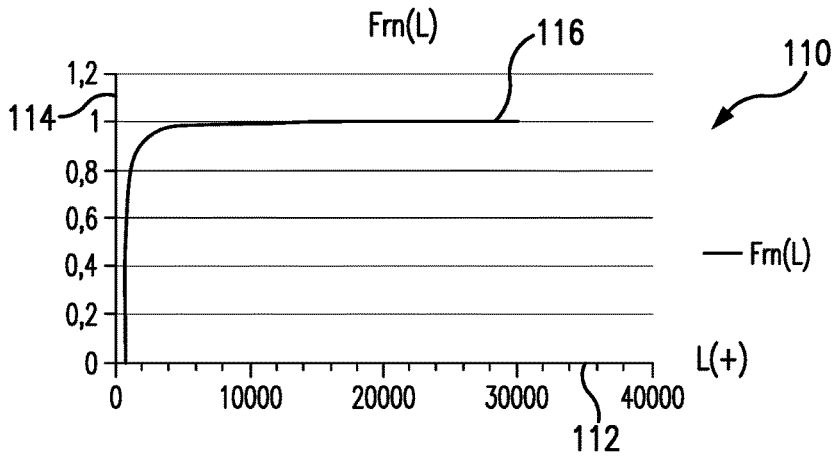
FIG. 7 is a sample plot of Frn(L), in accordance with exemplary embodiments of the present techniques.

Referring generally to FIG. 7, a chart illustrating the value of FRN(L) over a range of rod string loads is presented, and referenced generally by reference numeral 110. In this embodiment, the value of Lmin is 500 lbs and the value of $\alpha$ is 0.1. This value of Lmin ensures that floating rod effect will not occur. This value of a provides a desired chart shape of a value close to one (1) for most load values, but with a rapid drop in values as the load approaches Lmin, i.e., closer to floating rod effect occuring. The X-axis 112 represents values for L(t), the load on the rod string. The values for L(t) shown are from 0 lbs to 40,000 lbs. The Y-axis 114 represents numerical values for FRN(L). These values range from 0 to 1.2. The plot of FRN(L) versus L(t) is identified by reference numeral 116. In this example, if L(t) remains above a value of approximately 10,000 lbs, then the value of FRN(L) is near 1. However, if the viscosity of the formation fluids is such that L(t) begins to decrease during a downstroke, the value of FRN(L) begins to decrease rapidly towards 0.

In the illustrated method, the method comprises establishing whether the value of FRN(L) is less than 0, as represented by block 120. If the value of FRN(L) based on the load is less than 0, then the value for FRN(L) is set at 0, as represented by block 122. However, if the value of FRN(L) is not less than 0, then the drive control system 42 established the motor 20 speed as a function of FRN(L) and the RPC speed, as represented by block 124. In the illustrated embodiment, the drive control system 42 establishes the motor 20 speed as a function of FRN(L) and the RPC speed, as follows:

$$\text{Speed}=RPC\ \text{speed}*FRN(L) \tag{3}$$

In the illustrated embodiment, the motor 20 speed is filtered with an IIR exponential smoothing filter, as represented by block 126. The user sets a decay constant for the IIR exponential smoothing filter in the illustrated embodiment.

In this embodiment, there are two additional speed parameters that are utilized to control the speed of the motor 20 during a downstroke. These two parameters are the Minimum Speed Rail (MSR) and the Absolute Minimum Speed (AMS). The MSR is employed to prevent the system from slowing down unnecessarily quickly due to a spurious or isolated signal from the load cell indicating that the load has momentarily increased; this could be introduced by spurious or dynamic transients high load readings during the down stroke. This is employed to ensure that the floating rod algorithm helps the rod pump system to achieve optimal production while protecting the mechanical components from the effects of striking the fluid column too quickly. The system may be configured to slow to a speed of 0 or to an AMS. The MSR value is calculated during the downstroke every scan (PLC cycle) and is a function of the rod position (P) and of the last calculated speed for the upstroke (RPC speed). The AMS, which may be zero, is a speed required for the safe mechanical operation of the system; since gearbox lubrication for some rod pumps requires a minimum speed. In the Illustrated embodiment, if the MSR is less than the AMS, then the MSR is set to the AMS, as represented by block 128.

In the illustrated embodiment, the speed is compared to the MSR 1 and if the speed is less than the MSR, then the speed is set at the MSR, as represented by block 129.

At the end of the downstroke, the scan cycle is finished and the process is returned to the beginning of a scan cycle, as represented by reference numeral 130. The scan cycle returns to block 90 and repeats the process for the next scan cycle.

Figure 8:
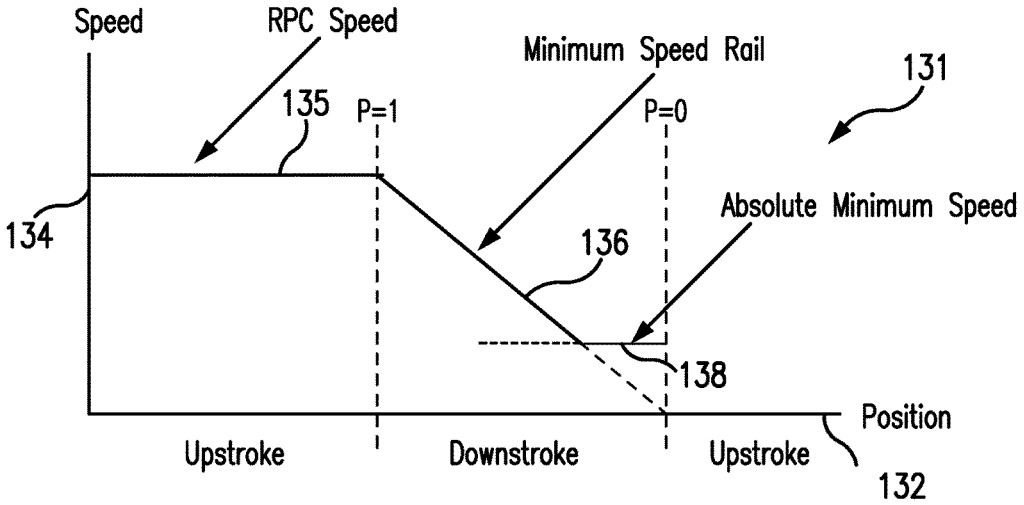
FIG. 8 is a chart representing a plot of one embodiment of rod speed during a downstroke, in accordance with exemplary embodiments of the present techniques.

Referring generally to FIG. 8, a chart of one embodiment of a minimum speed rail and absolute minimum speed is presented and represented generally by reference number 131. In this embodiment, the X-axis 132 represents rod position (P) and the Y-axis 134 represents motor speed. The plot of the MSR is represented by reference number 136. Position "P" equals one (1) at the start of the downstroke and position "P" equals zero (0) at the end of the downstroke. To establish the MSR, the current position fraction P(x) is multiplied by the RPC speed. This calculation describes a diagonal line between P=1 and P=0, the minimum speed rail, MSR. In this embodiment, there is an Absolute Minimum Speed (AMS) 138 that the motor 20 will operate. If the MSR is less than the Absolute Minimum Speed (AMS), the MSR is set to the AMS in this embodiment.

Figure 9:
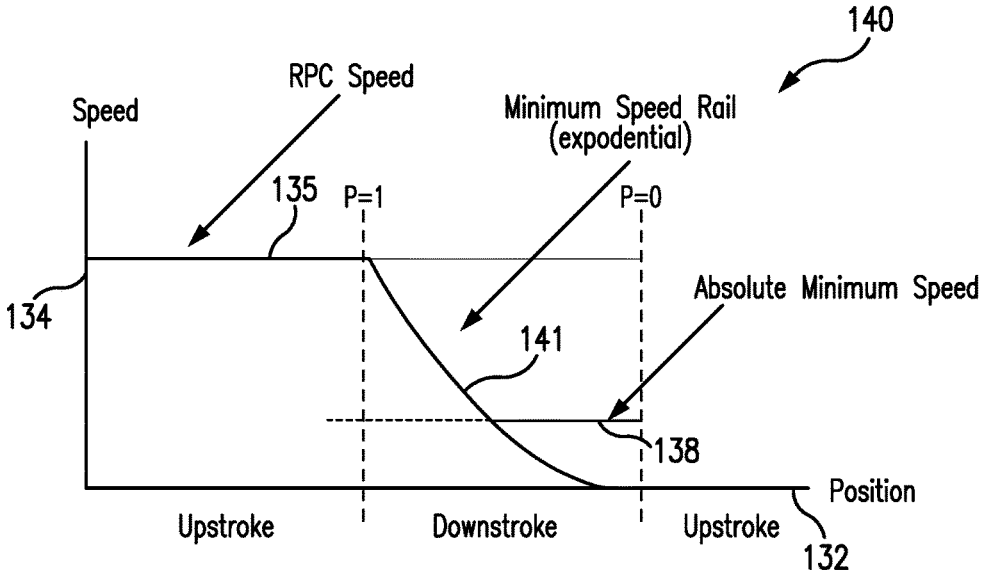
FIG. 9 is a chart representing a plot of a second embodiment of rod speed during a downstroke, in accordance with exemplary embodiments of the present techniques.

Referring generally to FIG. 9, an alternative embodiment of a MSR and AMS is presented and represented generally by reference numeral 140. Position P(1) equals the start of the downstroke and position P(0) equals the end of the down stroke. In this embodiment, the MSR 141 is established to produce an exponential decay between P=1 and P=0. As above, when the MSR 141 drops below the AMS 138, the MSR is set to the AMS. The MSR in this case is calculated using the formula:

$$MSR=(P(x)^{Analog\ Speed\ Exponent})*RPC\ \text{speed} \tag{4}$$

Where:

P(x) the fraction between 0 and 1 of the current position during the downstroke; and Analog Speed Exponent is a parameter specified based on the well's behavior.

Figure 10:
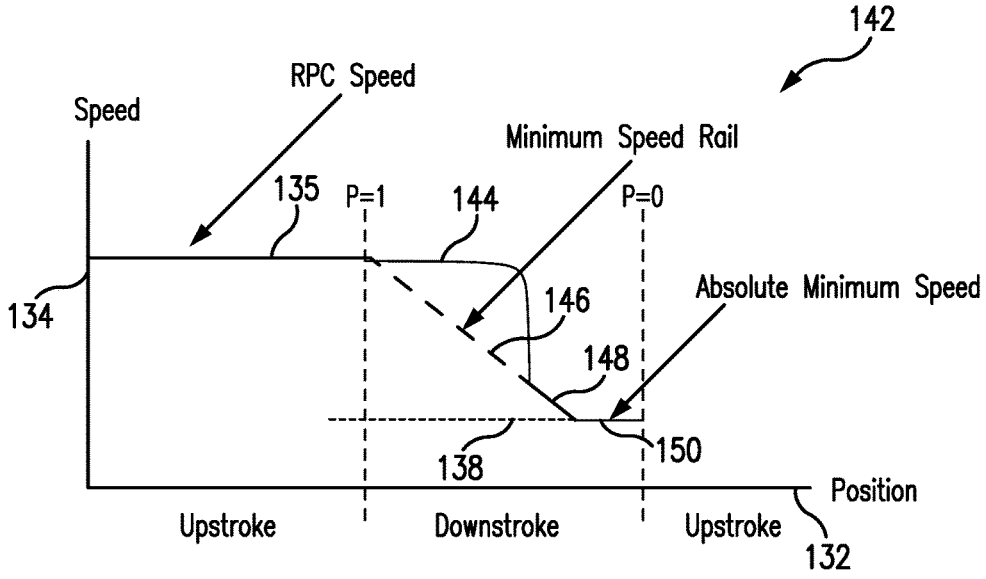
FIG. 10 is a chart representing a plot of actual motor speed during a downstroke in accordance with exemplary embodiments of the present techniques.

Referring generally to FIG. 10, a representation of motor speed during a downstroke cycle in accordance with the embodiments described above is presented and referenced generally by reference numeral 142. In the illustrated embodiment, the motor 20 speed is shown by the solid line. During the first portion of the downstroke, the actual motor speed 144 is based on FRN(L). Because FRN(L) has a value close to one (1) when the actual load is high, the actual motor speed is close to the upstroke speed for most of the downstroke. However, if the actual load, L(t), begins to decrease to a value approaching Lmin, FRN(L) begins to decrease at a greater than linear rate and motor speed decreases at a greater than linear rate preventing floating rod effect from occurring. In this embodiment, the MSR 146 decreases linearly over the course of the downstroke. In this embodiment, the FRN(L) speed decreases to the MSR. At that point, the actual speed becomes the MSR speed 148. In addition, in this embodiment, the MSR 146 drops below the AMS. At the point, the MSR equals the AMS, the MSR is set to equal the AMS and the actual motor speed 150 is set to the AMS.

As noted above, one or more specific embodiments of the present invention were provided above. In an effort to provide a concise description of these embodiments, not all features of an actual implementation were described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill h art and having the benefit of this disclosure.

What is claimed is:

1. A method for operating a sucker rod pumping system, comprising:

establishing a minimum desired load on a rod string of the sucker rod pumping system;

providing a signal representative of actual load on the rod string;

controlling speed of the sucker rod pumping system during a portion of the downstroke of the sucker rod system based on a non-linear relationship of actual load on the rod string and the minimum desired load on the rod string, wherein the speed of the pumping system decreases at a greater than linear rate as the actual load approaches the minimum desired load, wherein controlling the speed of the sucker rod pumping system during a downstroke of the sucker rod system comprises controlling the speed of the sucker rod pumping during a downstroke of the sucker rod system based on an upstroke speed and the non-linear relationship of actual load on the rod string and the minimum desired load on the rod string, and wherein controlling the speed of the sucker rod pumping system during a downstroke of the sucker rod system based on an upstroke speed and the non-linear relationship of actual load on the rod string and the minimum desired load on the rod string comprises multiplying the upstroke speed by the value for the difference between actual load and minimum desired load normalized by the actual load raised by an exponent having a value less than one.

2. The method as recited in claim 1, wherein the upstroke speed is the upstroke speed at the end of a previous upstroke.

3. The method as recited in claim 1, comprising controlling the speed of the sucker rod pumping system during a second portion of the downstroke of the sucker rod system based on rod position.

4. The method as recited in claim 3, wherein controlling the speed of the sucker rod pumping system during a third portion of the downstroke of the sucker rod system comprises controlling the speed of the sucker rod pumping system such that the motor speed does not decrease below a defined speed.

5. A drive controller for a sucker rod pumping system, comprising:

an interface operable to receive a signal representative of load on a rod string of the sucker rod pumping system and a signal representative of rod string position; and a motor speed controller programmed to reduce speed of the sucker rod pumping system during a downstroke of the sucker rod pumping system at a greater than linear rate as the load on the rod string approaches a specified load on the rod string, wherein the drive controller determines a difference between load on the rod string and the specified load on the rod string, and wherein the drive controller controls speed of the sucker rod during a downstroke of the sucker rod pumping system based on an upstroke speed and a normalized load value raised by an exponent having a value less than one.

6. The drive controller as recited in claim 5 wherein the upstroke speed is the upstroke speed at the end of a previous upstroke.

* * * * *